US011918929B2

(12) United States Patent
Zhuang

(10) Patent No.: US 11,918,929 B2
(45) Date of Patent: Mar. 5, 2024

(54) SQUEEZE TYPE STRESS RELIEVING TOY WITH WATER STORAGE FUNCTION

(71) Applicant: Guangxiang Zhuang, Shenzhen (CN)

(72) Inventor: Guangxiang Zhuang, Shenzhen (CN)

( * ) Notice: Subject to any disclaimer, the term of this patent is extended or adjusted under 35 U.S.C. 154(b) by 192 days.

(21) Appl. No.: 17/730,258

(22) Filed: Apr. 27, 2022

(65) Prior Publication Data

US 2022/0249968 A1 Aug. 11, 2022

(51) Int. Cl.
*A63H 33/00* (2006.01)
*A63H 3/36* (2006.01)
*B65D 85/72* (2006.01)

(52) U.S. Cl.
CPC ..... *A63H 33/00* (2013.01); *B65D 85/72* (2013.01)

(58) Field of Classification Search
CPC ..... A63H 33/00; A63H 23/10; A63H 23/005; B65D 85/72; B65D 1/32; B65D 35/28; B65D 81/36
USPC ..... 446/71, 153, 320
See application file for complete search history.

(56) References Cited

U.S. PATENT DOCUMENTS

2002/0009947 A1 1/2002 Liao
2016/0101365 A1 4/2016 Lau
2016/0271504 A1 9/2016 Lau

*Primary Examiner* — Nini F Legesse
(74) *Attorney, Agent, or Firm* — Jose Cherson Weissbrot

(57) ABSTRACT

The present disclosure discloses a squeeze type stress relieving toy with a water storage function, including an outer bottle body; a bottle cover which is detachably connected to the outer bottle body; a fixed cover which is fixedly arranged on the outer bottle body and is wrapped by the bottle cover; an isolation structure which is arranged in the outer bottle body and disposed below the fixed cover; a paste discharge simulation structure which movably penetrates through the fixed cover and is arranged above the isolation structure; the squeeze rod is movably arranged in the fixed cover through a reset device; the simulation part is sleeved on the squeeze rod; the reset device, two ends of which are respectively connected to the paste discharge simulation structure and the fixed cover; and a liquid injection structure which penetrates through the fixed cover and is communicated to the outer bottle body.

10 Claims, 5 Drawing Sheets

SQUEEZE TYPE STRESS RELIEVING TOY WITH WATER STORAGE FUNCTION

TECHNICAL FIELD

The present disclosure relates to the technical field of toys, specifically to a squeeze type stress relieving toy with a water storage function.

BACKGROUND

With the acceleration of the pace of social life, people's work stress increasingly grows and is difficult to relieve, so some people need to relieve stress by decompression. Related studies show that the handfed of squeezing things can bring a kind of pleasure, and this kind of pleasure has a certain decompression effect. Therefore, in view of the shortcomings in the actual production and implementation of the above-mentioned solutions, the shortcomings are corrected and improved. Meanwhile, in line with the good spirit and concept, under the assistance of professional knowledge and experience, after thinking and testing in many ways, this design is created. Therefore, a squeeze type stress relieving toy with a water storage function is provided, so as to solve the above-mentioned problems.

SUMMARY

One of the purposes of the present disclosure is to provide a squeeze type stress relieving toy with a water storage function, so as to solve the above-mentioned problems.

The squeeze type stress relieving toy with the water storage function of the present disclosure can be achieved by the following technical solution:

A squeeze type stress relieving toy with a water storage function of the present disclosures includes an outer bottle body which is a hollow chamber, where the outer bottle body has a squeeze function; a bottle cover which is detachably connected to the outer bottle body; a fixed cover which is fixedly arranged on the outer bottle body and is wrapped by the bottle cover; an isolation structure which is arranged in the outer bottle body and disposed below the fixed cover, where the isolation structure adopts a flexible material; a paste discharge simulation structure which movably penetrates through the fixed cover and is arranged above the isolation structure, where the paste discharge simulation structure includes a squeeze rod and a simulation part; the squeeze rod is movably arranged in the fixed cover through a reset device; the simulation part is sleeved on the squeeze rod; when the outer bottle body is squeezed, the isolation structure drives the squeeze rod to move and contact the fixed cover for squeezing; the simulation part simulates paste discharge; the reset device, two ends of which are respectively connected to the paste discharge simulation structure and the fixed cover, where the reset device provides a restoration force for the paste discharge simulation structure; and a liquid injection structure which penetrates through the fixed cover and is communicated to the outer bottle body, where the liquid injection structure has a retractable structure.

In one implementation, the liquid injection structure includes a liquid injection cover, a fixed pipe, and a movable pipe; the fixed pipe is fixedly arranged on the fixed cover and penetrates through the fixed cover; the movable pipe is sleeved on the fixed pipe, can move relative to the fixed pipe, and extends into the outer bottle body; and the liquid injection cover is detachably arranged above the fixed pipe and the movable pipe, respectively.

In one implementation, the liquid injection cover includes a liquid injection cover body and an outer cover; the liquid injection cover body is detachably arranged above the fixed pipe and the movable pipe, respectively; and the outer cover is movably arranged on the liquid injection cover body.

In one implementation, an upper internal thread and a lower internal thread are arranged in the liquid injection cover body; the upper internal thread is matched with the movable pipe; and the lower internal thread is matched with the fixed pipe.

In one implementation, an upper end of the fixed pipe is provided with a first external thread; an upper end of the movable pipe is provided with a second external thread; and the first external thread and the second external thread are respectively matched with the lower internal thread and the upper internal thread.

In one implementation, a waterproof ring is arranged at a contact position between the fixed pipe and the fixed cover.

In one implementation, a material of the outer bottle body is an aluminum material or an aluminum-plastic composite material.

In one implementation, the outer bottle body is shaped like a flat tube, cylindrical, rectangular, or conical.

In one implementation, the material of the isolation structure is balloon-shaped food-grade silica gel, food-grade rubber, or safe plastic.

In one implementation, the reset device is an elastic cord.

Compared with the prior art, the squeeze type stress relieving toy with the water storage function of the present disclosure has the beneficial effects:

According to the squeeze type stress relieving toy with the water storage function of the present disclosure, the outer bottle body is squeezed to enable the isolation structure to drive the paste discharge simulation structure to realize a paste discharge simulation function. Based on the concept of squeezing toothpaste, when a squeezing force disappears, the paste discharge simulation structure is restored to an original position under the action of the reset device, so that simulated paste of the paste discharge simulation structure flows back, which effectively realizes the stress relieving function. A user can also drink a flowing substance in the outer bottle body through the liquid injection structure, so that various purposes of the toy are achieved. At the same time, when the flowing substance in the outer bottle body is insufficient, a flowing substance can be injected through the liquid injection structure, so that a cyclic drinking function of the toy is realized.

BRIEF DESCRIPTION OF THE DRAWINGS

In order to explain the technical solutions of the embodiments of the present disclosure more clearly, the following will briefly introduce the accompanying drawings used in the embodiments. It should be understood that the drawings in the following description only illustrate some embodiments of the present disclosure and thus shall not be deemed as limiting the scope. Those of ordinary skill in the art can obtain other related drawings based on these drawings without creative work.

Figure 1:
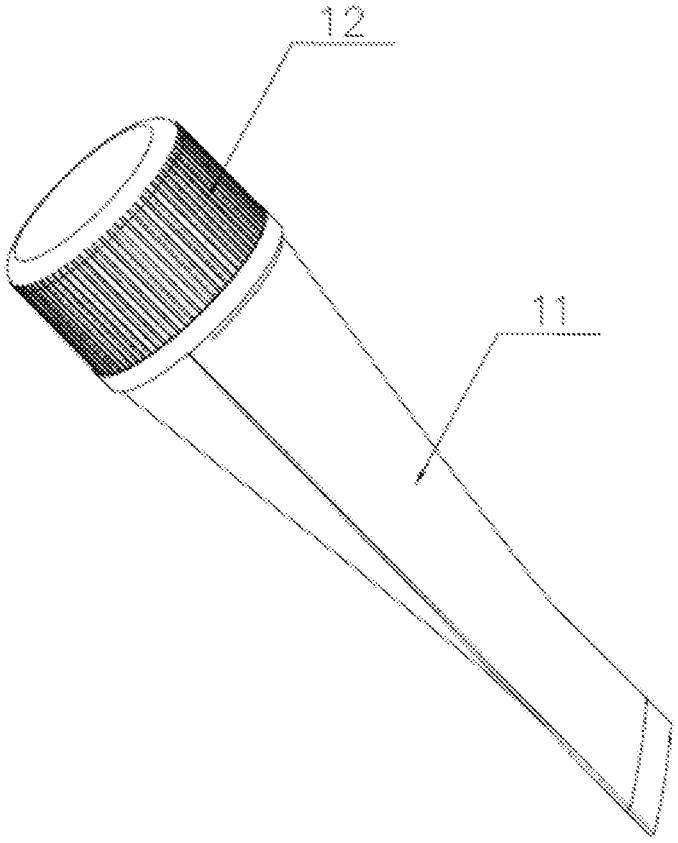
FIG. 1 is a schematic structural diagram of a squeeze type stress relieving toy with a water storage function of the present disclosure.
Figure 2:
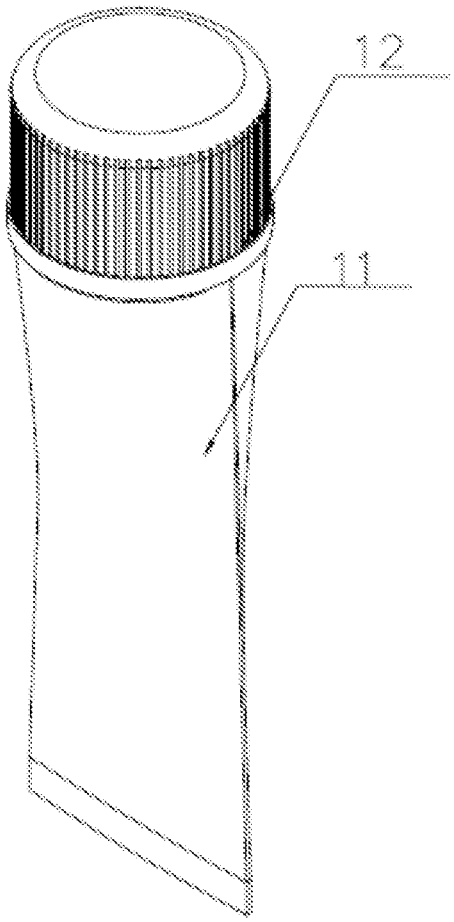
FIG. 2 is a schematic structural diagram of another side surface of the squeeze type stress relieving toy with a water storage function of the present disclosure shown in FIG. 1.

Reference numerals in the drawings: 11: outer bottle body; 12: bottle cover; 13: fixed cover; 131: fixed cover main body; 132: cover plate; 14: isolation device; 15: paste discharge simulation structure; 151: squeeze rod; 152: simulation part; 16: reset device; 17: liquid injection structure; 171: liquid injection cover; 1711: liquid injection cover body; 17111: upper internal thread; 17112: lower internal thread; 1712: outer cover; 172: fixed pipe; 1721: first external thread; 173: movable pipe; 1731: second external thread; 174: waterproof ring.

DETAILED DESCRIPTION OF THE EMBODIMENTS

In order to make the objectives, technical solutions and advantages of the embodiments of the present disclosure clearer, the technical solutions in the embodiments of the present disclosure will be described clearly and completely below in combination with the drawings in the embodiments of the present disclosure. Obviously, the embodiments described herein are part of the embodiments of the present disclosure, not all the embodiments. The components of the embodiments of the present disclosure generally described and shown in the drawings here can be arranged and designed in a variety of different configurations.

Therefore, the following detailed description for the embodiments of the present disclosure provided in the accompanying drawings is not intended to limit the scope of the claimed present disclosure, but merely represents selected embodiments of the present disclosure. Based on the embodiments in the present disclosure, all other embodiments obtained by those of ordinary skill in the art without creative work shall fall within the protection scope of the present disclosure.

It should be noted that similar reference signs and letters indicate similar items in the following drawings. Therefore, once a certain item is defined in one drawing, it is unnecessary to be further defined and explained in the subsequent drawings.

In the description of the present disclosure, it should be noted that orientations or positional relationships indicated by the terms "upper", "lower", and the like are orientations or positional relationships as shown based on the drawings, or orientations or positional relationships where this invention product are usually placed, and are only for the purpose of facilitating and simplifying the description of the present disclosure instead of indicating or implying that devices or elements indicated must have particular orientations, and be constructed and operated in the particular orientations, so that these terms cannot be construed as limiting the present disclosure.

In addition, in the present disclosure, unless otherwise clearly defined and defined, the first feature being above or under the second feature may include that the first and second features are in direct contact, or may include that the first and second features are not in direct contact but in contact through other features between them. Moreover, the first feature being "on", "at the upper side of", and "on the upper surface of" the second feature includes that the first feature is right above and at the oblique upper side of the second feature, or only indicates that the horizontal height of the first feature is greater than that of the second feature. The first feature being "below", "at the lower side of", and "on the lower surface of" the second feature includes that the first feature is right below and at the oblique lower side of the second feature, or only indicates that the horizontal height of the first feature is less than that of the second feature.

In addition, the terms "horizontal", "vertical", and the like do not mean that the component is required to be absolutely horizontal or overhanging, but may be slightly inclined. For example, "horizontal" only means that its direction is more horizontal than "vertical", and it does not mean that the structure must be completely horizontal, but can be slightly inclined.

In the description of the present disclosure, it should be also noted that unless otherwise explicitly defined and defined, the terms "arranged", "coupled" and "connected" shall be understood broadly, and may be, for example, fixedly connected, or detachably connected, or integrally connected, or mechanically connected, or electrically connected, or directly connected, or indirectly connected through an intermediate medium, or interconnection between two elements. Those of ordinary skill in the art can understand the specific meanings of the above terms in the present disclosure according to specific situations.

Referring to FIG. 1 to FIG. 4, a squeeze type stress relieving toy with a water storage function of the present disclosure mainly includes an outer bottle body 11, a bottle cover 12, a fixed cover 13, an isolation structure 14, a paste discharge simulation structure 15, a reset device 16, and a liquid injection structure 17. The outer bottle body 11 is a hollow chamber, and has a squeeze function. A flowing substance can be accommodated in the outer bottle boy 11. The flowing substance may be beverage or jelly. The bottle cover 12 is detachably connected to the outer bottle body 11. The fixed cover 13 is fixedly arranged on the outer bottle body 11 and is wrapped by the bottle cover 12. The isolation structure 14 is arranged in the outer bottle body 11 and disposed below the fixed cover 13. The isolation structure adopts a flexible material. The isolation structure 14 prevents the flowing substance in the outer bottle body 11 from entering the fixed cover 13. The paste discharge simulation structure 15 movably penetrates through the fixed cover 13 and is arranged above the isolation structure 14. One end of the reset device 16 is connected to the paste discharge simulation structure 15, and the other end of the reset device is connected to the fixed cover 13. When the isolation structure 14 is squeezed, an acting force will be applied to the paste discharge simulation structure 15, so that the paste discharge simulation structure 15 outwardly moves. The paste discharge simulation structure 15 squeezes a through hole of the fixed cover 13 to achieve a paste discharge simulation state. When the squeezing force disappears, the paste discharge simulation structure 15 is restored to an initial position under the action of the reset device 16 to achieve backflow of simulated paste. The liquid injection structure 17 penetrates through the fixed cover 13 and is communicated with the outer bottle body 11, so that the flowing substance can be injected into or drunk from the outer bottle body 11 through the liquid injection structure 17.

Referring to FIG. 1 to FIG. 4, in this embodiment, the outer bottle body 11 is shaped like a flat tube. In other embodiments, the outer bottle body 11 may also be cylindrical, rectangular, conical, or of other shapes. A material of the outer bottle body 11 may be aluminum or an aluminum-plastic composite material. In this embodiment, the outer bottle body 11 adopts the aluminum-plastic composite material. The aluminum-plastic composite material is formed by compounding plastic and an aluminum foil. In this embodiment, an internal thread is arranged in the bottle cover 12, and an external thread is arranged on the fixed cover 13. By means of cooperation between the internal thread and the external thread, the bottle cover 12 is detachably mounted on the outer bottle body 11. In some embodiments, the bottle cover 12 and the fixed cover 13 are respectively provided with a fastener and a fastening slot. By means of cooperation between the fastener and the fastening slot, the bottle cover 12 is detachably mounted on the outer bottle body 11.

Figure 4:
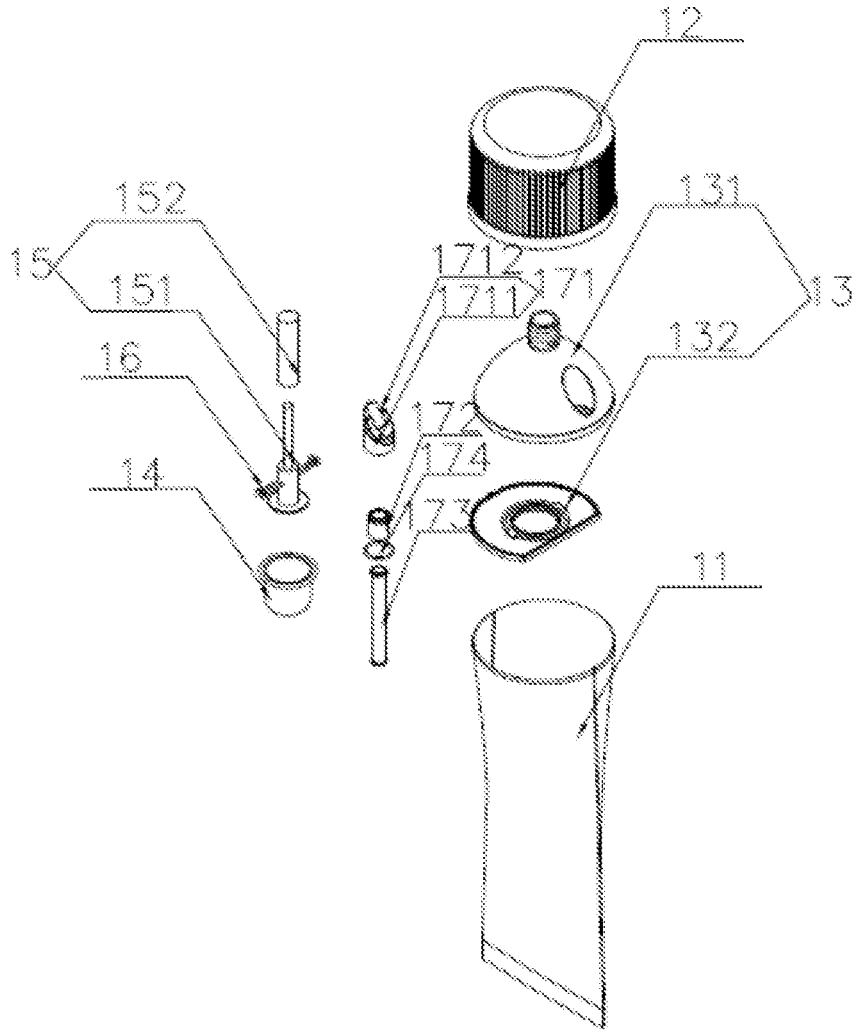
FIG. 4 is a schematic exploded structural diagram of the squeeze type stress relieving toy with a water storage function of the present disclosure shown in FIG. 1.

Referring to FIG. 4, in this embodiment, the fixed cover 13 includes a fixed cover main body 131 and a cover plate 132. The cover plate 132 is arranged below the fixed cover main body 131. Through holes are formed in positions, respectively corresponding to the positions of the paste discharge simulation structure 15 and the liquid injection structure 17, on the fixed cover main body 131. The paste discharge simulation structure 15 and the liquid injection structure 17 respectively penetrate through the fixed cover main body 131 through the corresponding through holes.

Figure 3:
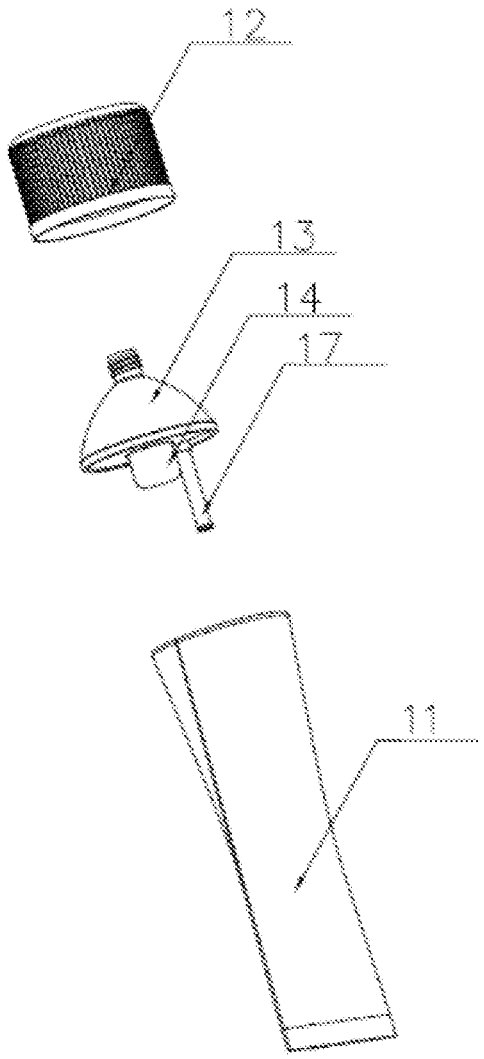
FIG. 3 is a partially schematic exploded structural diagram of the squeeze type stress relieving toy with a water storage function of the present disclosure shown in FIG. 1.

Referring to FIG. 3 and FIG. 4, the material of the isolation structure 14 may be balloon-shaped food-grade silica gel, food-grade rubber, or safe plastic. In this embodiment, the isolation structure 14 adopts the balloon-shaped food-grade silica gel.

Referring to FIG. 4, in this embodiment, the paste discharge simulation structure 15 includes a squeeze rod 151 and a simulation part 152. The squeeze rod 151 is movably arranged in the fixed cover 13 through the reset device 16. The simulation part 152 is sleeved on the squeeze rod 151. A material of the simulation part 152 is rubber or plastic. Specifically, the material of the simulation part 152 is silica gel. The reset device 16 is an elastic member. Specifically, the reset device 16 is an elastic cord or a spring. In this embodiment, the reset device 16 adopts an elastic cord. When the outer bottle body 11 is squeezed, a squeezing force applies an acting force to the isolation structure 14, so that the squeeze rod 151 outwardly moves, and the simulation part 152 outwardly moves with the squeeze rod 151. The simulation part 152 contacts and squeezes the through hole in the fixed cover 13, thus achieving a paste discharge simulation operation. When the external force acting on the outer bottle body 11 disappears, the reset device 16 drives the squeeze rod 151 to be restored to the initial position, and the simulation part 152 is also restored to the initial position along with the squeeze rod 151, thus achieving a paste backflow simulation operation.

Figure 5:
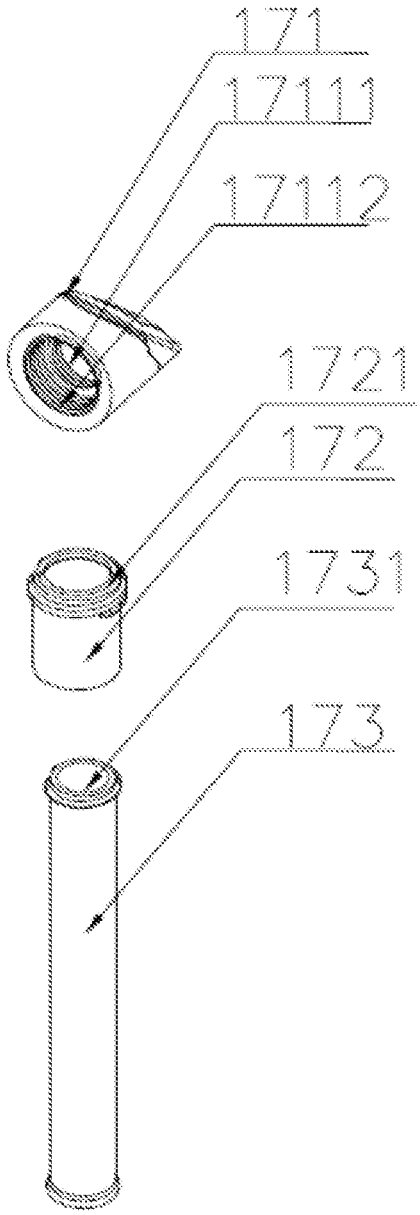
FIG. 5 is a schematic exploded structural diagram of a liquid injection pipe in the squeeze type stress relieving toy with a water storage function of the present disclosure shown in FIG. 4.

Referring to FIG. 3 to FIG. 5, in this embodiment, the liquid injection structure 17 includes a liquid injection cover 171, a fixed pipe 172, and a movable pipe 173; the fixed pipe 172 is fixedly arranged on the fixed cover 13 and penetrates through the fixed cover 13; the movable pipe 173 is sleeved on the fixed pipe 172 and can move relative to the fixed pipe 172; the movable pipe 173 extends into the outer bottle body 11; and the liquid injection cover 171 is detachably arranged above the fixed pipe 172 and the movable pipe 173, respectively. In this embodiment, the liquid injection cover 171 comprises a liquid injection cover body 1711 and an outer cover 1712; the liquid injection cover body 1711 is detachably arranged above the fixed pipe. 172 and the movable pipe 173, respectively; and the outer cover 1712 is movably arranged on the liquid injection cover body 1711. When the outer cover 1712 is opened, a flowing substance can be injected into the movable pipe 173. An upper internal thread 17111 and a lower internal thread 17112 are arranged in the liquid injection cover body 1711. The upper internal thread 17111 is matched with the movable pipe 173; and the lower internal thread 17112 is matched with the fixed pipe 172. In this embodiment, an upper end of the fixed pipe 172 is provided with a first external thread 1721; an upper end of the movable pipe 173 is provided with a second external thread 1731; and the first external thread 1721 and the second external thread 1731 are respectively matched and used with the lower internal thread 17112 and the upper internal thread 17111. When the flowing substance is required to be injected into the outer bottle body 11, the lower internal thread 17112 is first screwed down from the first external thread 1721; by the threaded connection between the upper internal thread 17111 and the second external thread 1731, the liquid injection cover 171 is connected to the movable pipe 173; the movable pipe 173 is pulled out from the fixed pipe 172; the outer cover 1712 is opened, and the flowing substance is injected into the isolation structure 14 through the movable pipe 173. For better sealing performance, a waterproof ring 174 is arranged at a contact position between the fixed pipe 172 and the fixed cover 13 to prevent the flowing substance in the outer bottle body 11 from leaking out of the contact position between the fixed pipe 172 and the fixed cover 13. A material of the waterproof ring 174 is plastic or rubber. Specifically, the material of the waterproof ring 174 is silica gel. In some embodiments, the fixed cover 13 is not provided with the liquid injection structure 17. The flowing substance is preloaded in the isolation structure 14.

It should be noted that the working process of the squeeze type stress relieving toy with the water storage function is as follows: The bottle cover 12 is removed from the outer bottle body 11. The outer bottle body 11 is squeezed, so that the isolation structure 14 drives the paste discharge simulation structure 15 to outwardly move. The simulation part 152 contacts and squeezes the fixed cover 13 to achieve a paste discharge simulation effect. When the squeezing force disappears, the paste discharge simulation structure 15 is restored to the initial position under the action of the reset device 16, so that the simulation part 152 flows back. At the same time, the user can also drink the food or beverage in the outer bottle body 11 through the liquid injection structure 17. When the food or beverage in the outer bottle body 11 is insufficient, food or beverage can be injected through the liquid injection structure 17.

The technical features of the embodiments described above can be arbitrarily combined. In order to make the description concise, all possible combinations of various technical features in the above embodiments are not completely described. However, the combinations of these technical features should be considered as the scope described in the present specification as long as there is no contradiction in them.

The above-mentioned embodiments only express several implementation modes of the present disclosure, and their descriptions are more specific and detailed, but they cannot be understood as limiting the patent scope of the present disclosure. It should be noted that those of ordinary skill in the art can further make various transformations and improvements without departing from the concept of the disclosure, and these transformations and improvements all fall within the protection scope of the present disclosure. Therefore, the protection scope of the patent of the present disclosure shall be subject to the appended claims.

What is claimed is:

1. A squeeze type stress relieving toy with a water storage function, comprising an outer bottle body which is a hollow chamber, wherein the outer bottle body has a squeeze function;

a bottle cover which is detachably connected to the outer bottle body;

a fixed cover which is fixedly arranged on the outer bottle body and is wrapped by the battle cover;

an isolation structure which is arranged in the outer bottle body and disposed below the fixed cover, wherein the isolation structure adopts a flexible material;

a paste discharge simulation structure which movably penetrates through the fixed cover and is arranged above the isolation structure, wherein the paste discharge simulation structure comprises a squeeze rod and a simulation part; the squeeze rod is movably arranged in the fixed cover through a reset device; the simulation part is sleeved on the squeeze rod; when the outer bottle body is squeezed, the isolation structure drives the squeeze rod to move and contact the fixed cover for squeezing; and the simulation part simulates paste discharge;

the reset device, two ends of which are respectively connected to the paste discharge simulation structure and the fixed cover, wherein the reset device provides a restoration force for the paste discharge simulation structure; and a liquid injection structure which penetrates through the fixed cover and is communicated to the outer bottle body, wherein the liquid injection structure has a retractable structure.

2. The squeeze type stress relieving toy with the water storage function according to claim 1, wherein the liquid injection structure comprises a liquid injection cover, a fixed pipe, and a movable pipe; the fixed pipe is fixedly arranged on the fixed cover and penetrates through the fixed cover; the movable pipe is sleeved on the fixed pipe, is capable of moving relative to the fixed pipe, and extends into the outer bottle body; and the liquid injection cover is detachably arranged above the fixed pipe and the movable pipe, respectively.

3. The squeeze type stress relieving toy with the water storage, function according to claim 2, wherein the liquid injection cover comprises a liquid injection cover body and an outer cover; the liquid injection cover body is detachably arranged above the fixed pipe and the movable pipe, respectively; and the outer cover is movably arranged on the liquid injection cover body.

4. The squeeze type stress relieving toy with the water storage function according to claim 3, wherein an upper internal thread and a lower internal thread are arranged m the liquid injection cover body; the upper internal thread is matched with the movable pipe; and the lower internal thread is matched with the fixed pipe.

5. The squeeze type stress relieving toy with the water storage function according to claim 4, wherein an upper end of the fixed pipe is provided with a first external thread; an upper end of the movable pipe is provided with a second external thread; and the first external thread and the second external thread are respectively matched with the lower internal thread and the upper internal thread.

6. The squeeze type stress relieving toy with the water storage function according to claim 2, wherein a waterproof ring is arranged at a contact position between the fixed pipe and the fixed cover.

7. The squeeze type stress relieving toy with the water storage function according to claim 1, wherein a material of the outer bottle body is an aluminum material or an aluminum-plastic composite material.

8. The squeeze type stress relieving toy with the water storage function according to claim 1, wherein the outer bottle body is shaped like a flat tube, cylindrical, rectangular, or conical.

9. The squeeze type stress relieving toy with the water storage function according to claim 1, wherein the material of the isolation structure is balloon-shaped food-grade silica gel, food-grade rubber, or safe plastic.

10. The squeeze type stress relieving toy with the water storage function according to claim 1, wherein the reset device is an elastic cord.

* * * * *